US005908193A

United States Patent [19]

Houman

[11] Patent Number: 5,908,193

[45] Date of Patent: Jun. 1, 1999

[54] GAME BOARD FOR CHESS, CHECKERS, AND THE LIKE

[76] Inventor: Nader Houman, 10700 Wilshire Blvd., Apt. 206, Los Angeles, Calif. 90024

[21] Appl. No.: 08/854,505

[22] Filed: May 12, 1997

[51] Int. Cl.[6] ..... A63F 3/02

[52] U.S. Cl. ..... 273/261

[58] Field of Search ..... 273/242, 243, 273/260, 261

[56] References Cited

U.S. PATENT DOCUMENTS

| | | | |
|---|---|---|---|
| 734,307 | 7/1903 | Curran | 273/261 X |
| 3,652,091 | 3/1972 | Zubrin | 273/261 |
| 3,964,747 | 6/1976 | Balmforth | 273/261 |
| 4,190,254 | 2/1980 | Leeds | 273/261 |
| 4,249,741 | 2/1981 | Buijendorp | 273/261 |

FOREIGN PATENT DOCUMENTS

| | | | |
|---|---|---|---|
| 335792 | 12/1903 | France | 273/261 |
| 2406462 | 8/1975 | Germany | 273/261 |
| 2648345 | 4/1978 | Germany | 273/261 |
| 7713875 | 6/1979 | Netherlands | 273/261 |
| 1576313 | 10/1980 | United Kingdom | 273/261 |

*Primary Examiner*—William E. Stoll
*Attorney, Agent, or Firm*—Timothy T. Tyson; Ted Masters; Freilich, Hornbaker & Rosen

[57] ABSTRACT

A game board (20) for playing chess or checkers, and the like, for two or more players. Each side of the game board (20) has seven edge stations or playing squares, (e1) through (e7), of two alternating contrasting colors, seven first interior stations, (f1) through (f7), also of two alternating contrasting colors, seven second interior stations, (s1) through (s7), also of two alternating contrasting colors, and a central area (ca). In a preferred embodiment in the initial playing position a first castle occupies e1, a first bishop occupies e2, a first knight occupies e3, a king and a queen occupy e4, a second bishop occupies e5, a second knight occupies e6, and a second castle occupies e7.

3 Claims, 8 Drawing Sheets

GAME BOARD FOR CHESS, CHECKERS, AND THE LIKE

TECHNICAL FIELD

The present invention pertains to game boards, and more particularly to a game board for playing chess, checkers, and the like.

BACKGROUND ART

The traditional games of chess and checkers are well known in the art, and are played on a game board having 64 squares arranged in eight rows of eight squares each, alternate squares being of two contrasting colors. Games played on such boards are generally restricted to two players. In an attempt to enhance the play of the game, and specifically in order to accommodate three or four players, numerous alternative game board designs have been conceived. For example, U.S. Pat. No. 5,125,666 shows a four-player chess game including a board having a main playing area made from a square matrix of eight-by-eight alternately colored playing spaces with two additional rows of eight alternately colored playing spaces adjacent each side of the main playing area. The game is played by placing each player's set of playing pieces on the game board so that each different set occupies two rows adjacent one side of the main playing area in a conventional chess arrangement. U.S. Pat. No. 4,708,349 defines a chess game for play by two, three, or four persons, which is played according to conventional rules of play. The game is played on a checkerboard having two hundred eight playing squares arranged in a central playing array of twelve bilaterally arranged rows having twelve squares per row and bordered by four smaller staging arrays, each of the staging arrays having eight bilaterally arranged rows of two squares per row. The players may play as individuals, or they may play as partners. U.S. Pat. No. 4,249,741 depicts a board for three player draughts and the like. The board is of hexagonal shape with a three-sided blocking area in the center. The board is divided into three equal territories. Three opposed sides of the board are bounded by "a" fields and the three other opposing sides by "b" fields, so as to form a pattern of 3×½a×b substantially rectangular fields of equal size. U.S. Pat. No. 4,190,254 discloses a "double-chess" board game for the playing of partnership chess by four participants. The playing area of the board is 8-sided, being bounded by four straight sides alternated with four curved sides formed by quarter circles. A symmetrical checkered pattern of 120 four-sided and 8 five-sided playing spaces is provided on which four standard sets of 16 chess pieces are placed. An octagonal space or gate is located at the center of the board. U.S. Pat. No. 4,067,578 comprises a chess board and pieces for play by four persons. The chess board has a "central field" of 8×8 squares. Sixteen diagonally disposed squares in the central field are called "combat bases", and extending from each side of the central field is an 8×4 squares "domain" for each player. U.S. Pat. No. 3,778,065 consists of a three-player chess game apparatus. The game apparatus consists of a hexagonal, planar board comprising a plurality of equidimensional, contiguous, uniformly distributed hexagonal playing spaces thereon and three sets of chessmen adapted to be disposed on the board and to be moved thereover in accordance with the rules of the game. U.S. Pat. No. 3,652,091 describes a three player chess board. The board is in the shape of a hexagon and is divided by transverse and longitudinal lines into three discrete territories, each of which territories includes 32 play spaces. U.S. Pat. No. 3,533,627 includes a three player chess board wherein each of the three players may simultaneously compete against the other two. The board is in the shape of a six-sided polygon of which three relatively long side alternate with three relatively short sides, and in which the relatively short sides are 3/7 of the length of the relatively long sides. U.S. Pat. No. 521,737 shows a six-sided game board having five playing spaces per side. The board is utilized to play a game different from chess. U.S. Pat. No. Des. 241,358 defines a chess game board designed for four players. The board has 192 squares. U.S. Pat. No. Des. 231,848 depicts a three player chess board. G.B. Patent 1,576,313 discloses a board for playing games normally played on a chess board. The board has 128 squares and allows play with four players. Eight curvilinear sides are provided, the odd sides marked with eight home squares of alternating light and dark color. The remainder of the board is marked with curvilinear lines of "squares" connecting home squares on adjacent sides. French Patent 2,504,811 comprises a board game for four players having 128 squares arranged in octagon or star shape. The central part of the board has 8 quadrilateral identical squares arranged in a regular star around the center. French Patent 335,792 describes a six-sided game board which can accommodate three players. German Patent 2,406,462 consists of a chess game for three persons having a board with triangular or polygonal zones, and a number of usual chess pieces per player. Each of the players have at least one additional piece at their disposal.

The present invention is directed to a game board for chess, checkers, and the like. The game board disclosed herein comprises a family of game boards having any number of sides "m", where m is four or greater. The game board employs a unique geometric principle, wherein each side of the board contains seven edge stations (playing squares) rather than the conventional eight normally used in chess or checkers. In counterclockwise order the seven edge stations are designated e1, e2, e3, e4, e5, e6, and e7. Edge station e1 is common with edge station e7 of the first adjacent side on the left (as viewed by a player), and edge station e7 is common with edge station e1 of the first adjacent side on the right.

Each side of the game board further includes seven first interior stations, designated f1 through f7, inwardly disposed adjacent to the seven edge stations, and seven second interior stations, designated s1 through s7, inwardly disposed adjacent to the seven first interior stations. That is, three ranks of stations emanate from each side of the game board. A central area is formed by the middle second interior stations.

The use of seven edge stations on each board side results in a board layout which permits all chess pieces, except one of the bishops, to enter into or pass over the central area, while simultaneously allowing the convenient placement of the chess pieces along one side of the board in an initial game position. No other number of edge stations exhibits these two properties. The odd number of edge stations positions the middle edge station in the middle of the side and thereby creates a straight line column across the central area to the middle edge station on the other side. In order to accommodate the one square reduction from eight to seven, the king and queen initially both occupy the middle edge station e4. Further, in order to have one bishop of each color, the order of the knights and bishops on the left side of the king and queen is reversed from that on the right side of the king and queen.

The game board can be used to play chess with only minor variations from the conventional rules of play. The game board can also be used to play checkers.

In accordance with a preferred embodiment of the invention, the game board has at least four sides. Seven edge stations are arranged in a rank along each of the sides. Seven first interior stations are arranged in a rank adjacent to and inward of the seven edge stations, and seven second interior stations are arranged in a rank adjacent to and inward of the seven first interior stations. A central area is formed by the middle stations of the second interior stations. The stations and central area of the game board are of alternating contrasting colors in a checkerboard pattern.

In accordance with an important aspect of the invention, the sides of the game board have a concave curvilinear shape.

In accordance with an important feature of the invention, each edge, first interior, and second interior station has a curvilinear quadrilateral shape.

In accordance with another preferred embodiment of the invention, chess pieces occupy the seven designated edge stations as follows;

e1—a first castle (rook);

e2—a first bishop;

e3—a first knight;

e4—a king, and a queen;

e5—a second bishop;

e6—a second knight, and e7—a second castle.

In accordance with an important aspect of the invention, the game board has six sides, is substantially hexagonal in shape, has a substantially hexagonal central area, and can accommodate either two or three players.

In accordance with an important feature of the invention, the game board has eight sides, is substantially octagonal in shape, has a substantially octagonal central area, and can accommodate four players.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
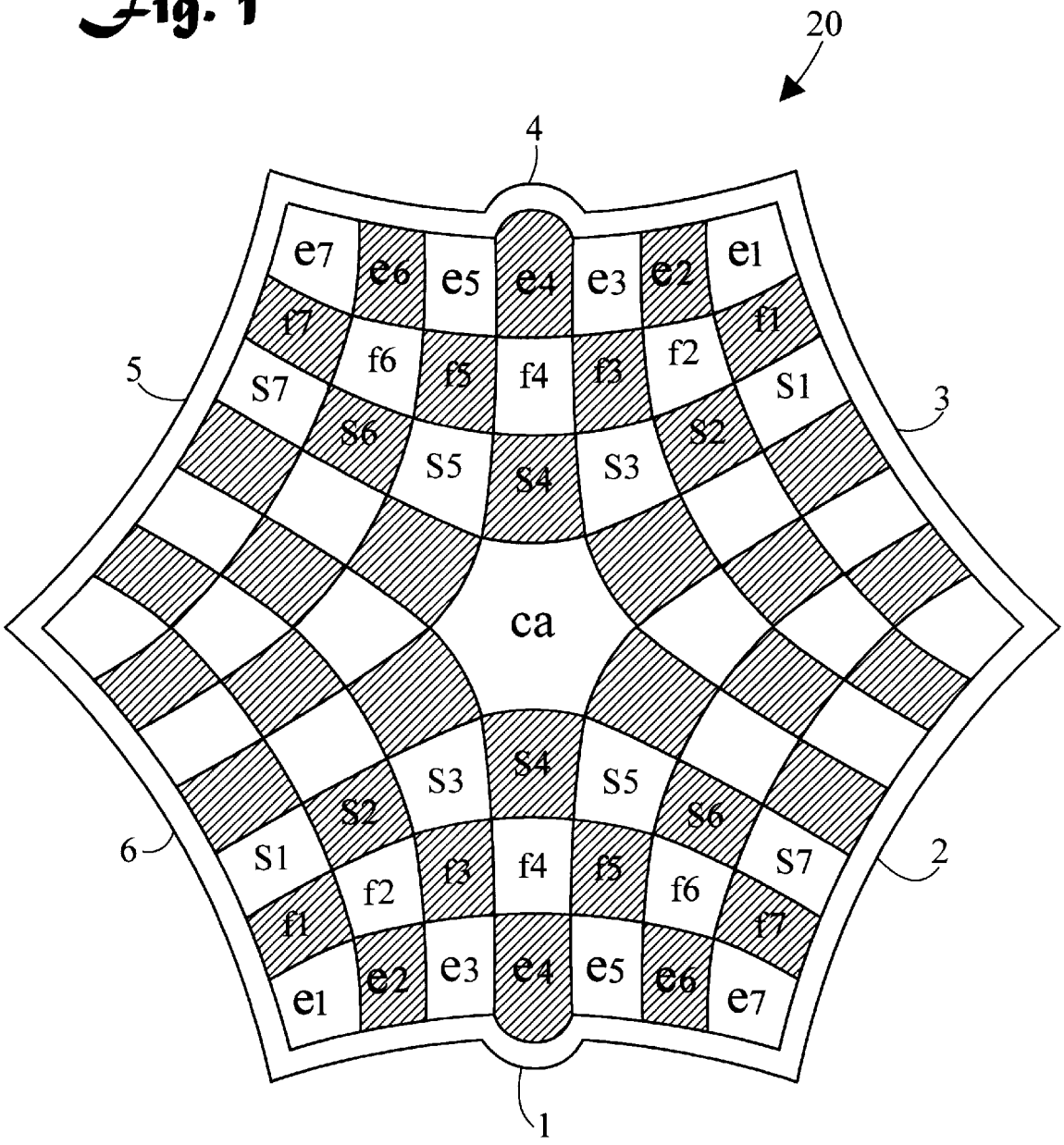
FIG. 1 is a top plan view of a game board in accordance with the present invention.

Referring initially to FIG. 1, there is illustrated a top plan view of a six-sided game board in accordance with the present invention, generally designated as 20. Game board 20 has at least four sides which are counterclockwise designated 1 through m, wherein side n is any side from 1 to m. In the shown embodiment game board 20 has six sides (m=6) and is substantially hexagonal in shape. While the shown embodiment has six sides, any number of sides equal to or greater than four can be utilized.

Seven edge stations (for clarity the edge stations are only designated for sides one and four) of two alternating contrasting colors are disposed along each side. The seven edge stations for each side are counterclockwise designated as e1, e2, e3, e4, e5, e6, and e7. The leftmost (as viewed by a player) end edge station is designated as e1, the middle edge station is designated as e4, and the rightmost end edge station is designated as e7. Edge station e1 of side n is common with edge station e7 of adjacent side n−1, and end edge station e7 of side n is common with edge station e1 of side n+1. That is, for side 1, edge station e1 is the same edge station as edge station e7 of adjacent side 6, and edge station e7 is the same edge station as edge station e1 of adjacent side 2. In the shown six-sided embodiment, there are a total of 36 edge stations.

Each side of game board 20 further includes seven first interior stations, designated as f1, f2, f3, f4, f5, f6, and f7 of two alternating contrasting colors inwardly disposed adjacent to the seven edge stations, and seven second interior stations, designated as s1, s2, s3, s4, s5, s6, and s7 of two alternating contrasting colors inwardly disposed adjacent to the seven first interior stations. The seven second interior stations each have a middle station s4. In the shown six-sided embodiment, game board 20 has 36 edge stations, 24 first interior stations, and 12 second interior stations. A central area, designated as ca, is formed by the boundaries of the middle second interior stations. Since game board 20 has m sides, central area ca will also have m sides, six in the shown embodiment. It may be appreciated that, except for the middle stations f4 and s4, all of the first interior and second interior stations are common with either a first or second interior station of an adjacent side. For example, first interior station f3 of side 1 is common with second interior edge station s6 of side 6, second interior station s2 of side 1 is common with first interior station f5 of side 6, first interior station f6 of side 1 is common with first interior station f2 of side 2, etc.

In a preferred embodiment, each of the game board 20 sides have a concave curvilinear shape, and the seven edge stations, the seven first interior stations, and the seven second interior stations, are symmetrically arranged in three curvilinear ranks.

Each individual station of the edge stations, first interior stations, and second interior stations form "squares" sized to receive a chess or checker piece. Since game board 20 is comprised of curvilinear lines and stations, the "squares" are necessarily not actually square, but rather of curvilinear quadrilateral shape. While the curvilinear embodiment is preferred, it would also be possible to construct a functionally equivalent game board 20 using straight lines, or straight line segments. Such an alternative construction is intended to be embraced by the inventive concepts disclosed and claimed herein.

A different way of describing the unique arrangement of the stations on game board 20 is the manner in which the edge stations are connected to the edge stations of other board sides. Edge station e1 of side n (e.g. side 1) is bendingly connected to edge station e7 of side n−2 (side 5) by five edge stations of side n−1 (side 6) of alternating contrasting colors. Edge station e2 of side 1 is bendingly connected to edge station e6 of side 5 by five first interior stations of side 6 of alternating contrasting colors. Edge station e3 of side 1 is bendingly connected to edge station e5 of side 5 by five second interior stations of side 6 of alternating contrasting colors. Edge station e5 of side 1 is bendingly connected to edge station e3 of side n+2 (side 3) by five second interior stations of side n+1 (side 2) of alternating contrasting colors. Edge station e6 of side 1 is bendingly connected to edge station e2 of side 3 by five first interior stations of side 2 of alternating contrasting colors. Edge station e7 of side 1 is bendingly connected to side 3 by five edge stations of side 2 of alternating contrasting colors. Finally, edge station e4 of side 1, the middle edge station, is connected to central area ca by first and second interior stations of alternating contrasting colors.

Figure 2:
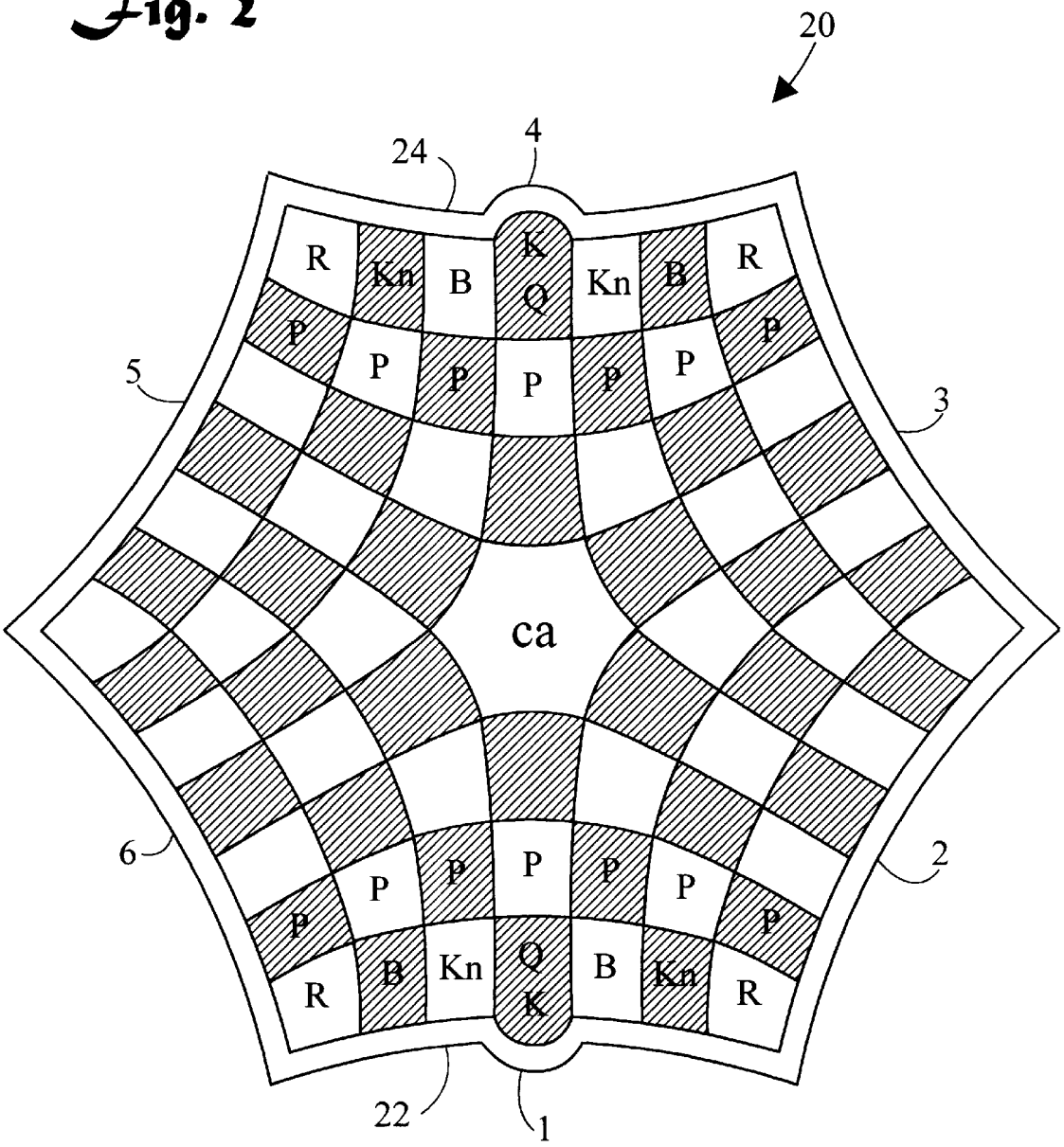
FIG. 2 is a top plan view of the game board of FIG. 1 showing two opposing sets of chess pieces in a first initial game position.

FIG. 2 is a top plan view of the game board 20 of FIG. 1 showing two opposing sets of chess pieces in a first initial game position, designed for use by two opposing players. Two of the game board 20 sides, 1 and opposite side 4 define playing positions 22 and 24 respectively. In the embodiment shown, the playing position sides are indicated by the slight bulge in edge stations e4. Board 20 is designed such than conventional chess pieces can occupy the seven designated edge stations as follows: (also refer to FIG. 1)

e1—a first castle (or rook);

e2—a first bishop;

e3—a first knight;

e4—a king, and a queen;

e5—a second bishop;

e6—a second knight; and e7—a second castle.

Additionally, a pawn is placed on each of the seven first interior stations.

The aforementioned initial piece placement on game board 20 has three unique and novel features. First, it is observed that since each game board 20 side has seven edge stations, it is not possible to position the chess pieces in a conventional manner. Therefore, both the king and queen initially occupy edge station e4. Second, the order of the bishops and knights is reversed on either side of the king and queen. This is to allow one bishop to reside on one color "square" (station), and the other bishop to reside on the other color square. Third, only seven pawns are used.

Figure 3:
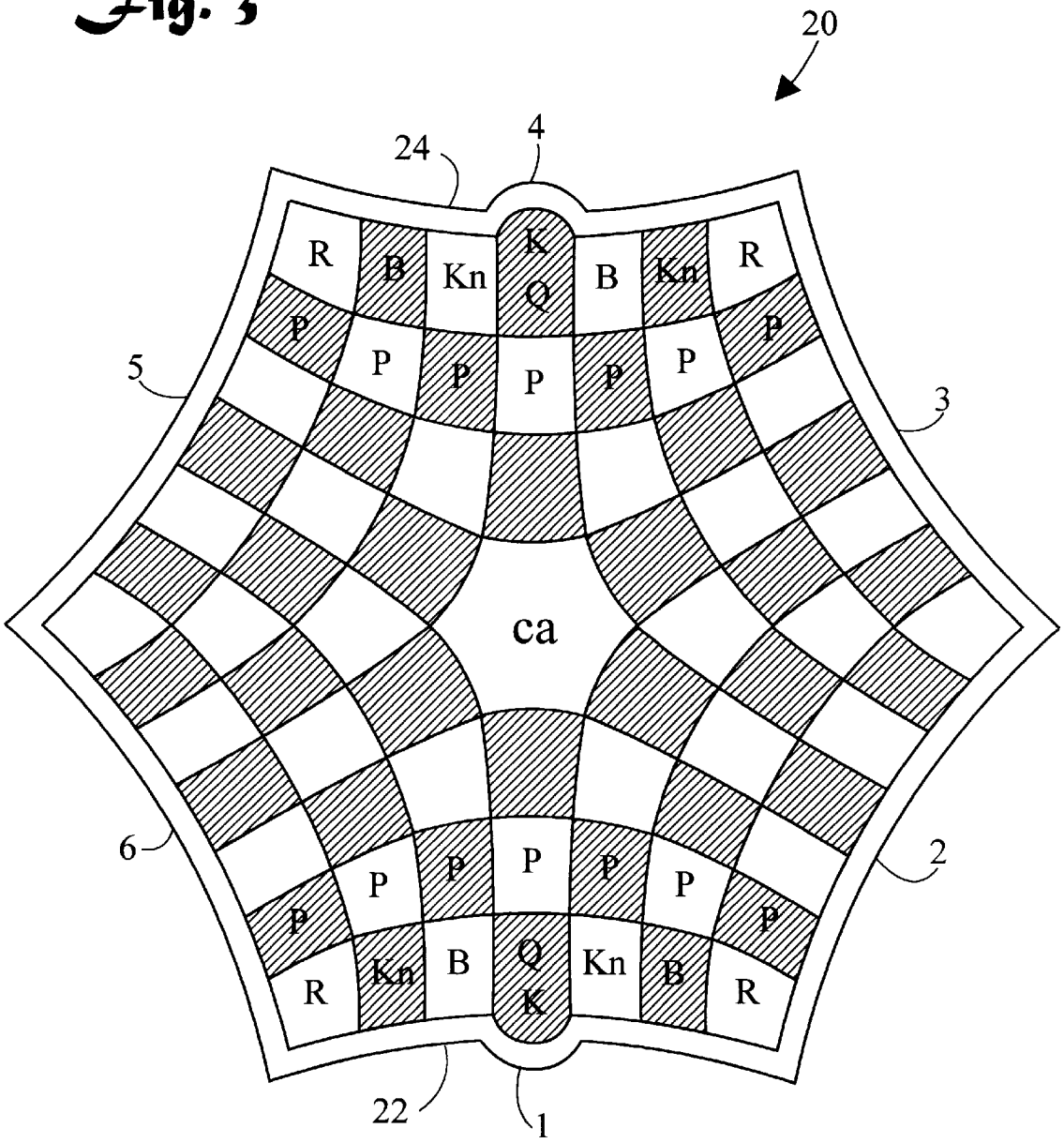
FIG. 3 is a top plan view of the game board of FIG. 1 showing two opposing sets of chess pieces in a second initial game position.

FIG. 3 is a top plan view of the game board of FIG. 1 showing two opposing sets of chess pieces in a second initial game position. Conventional chess pieces can occupy the seven designated edge stations as follows:

e1—a first castle (or rook);

e2—a first knight;

e3—a first bishop;

e4—a king, and a queen;

e5—a second knight;

e6—a second bishop; and e7—a second castle.

This embodiment is almost identical to FIG. 2, however the order of the bishops and knights have been reversed.

Figure 4:
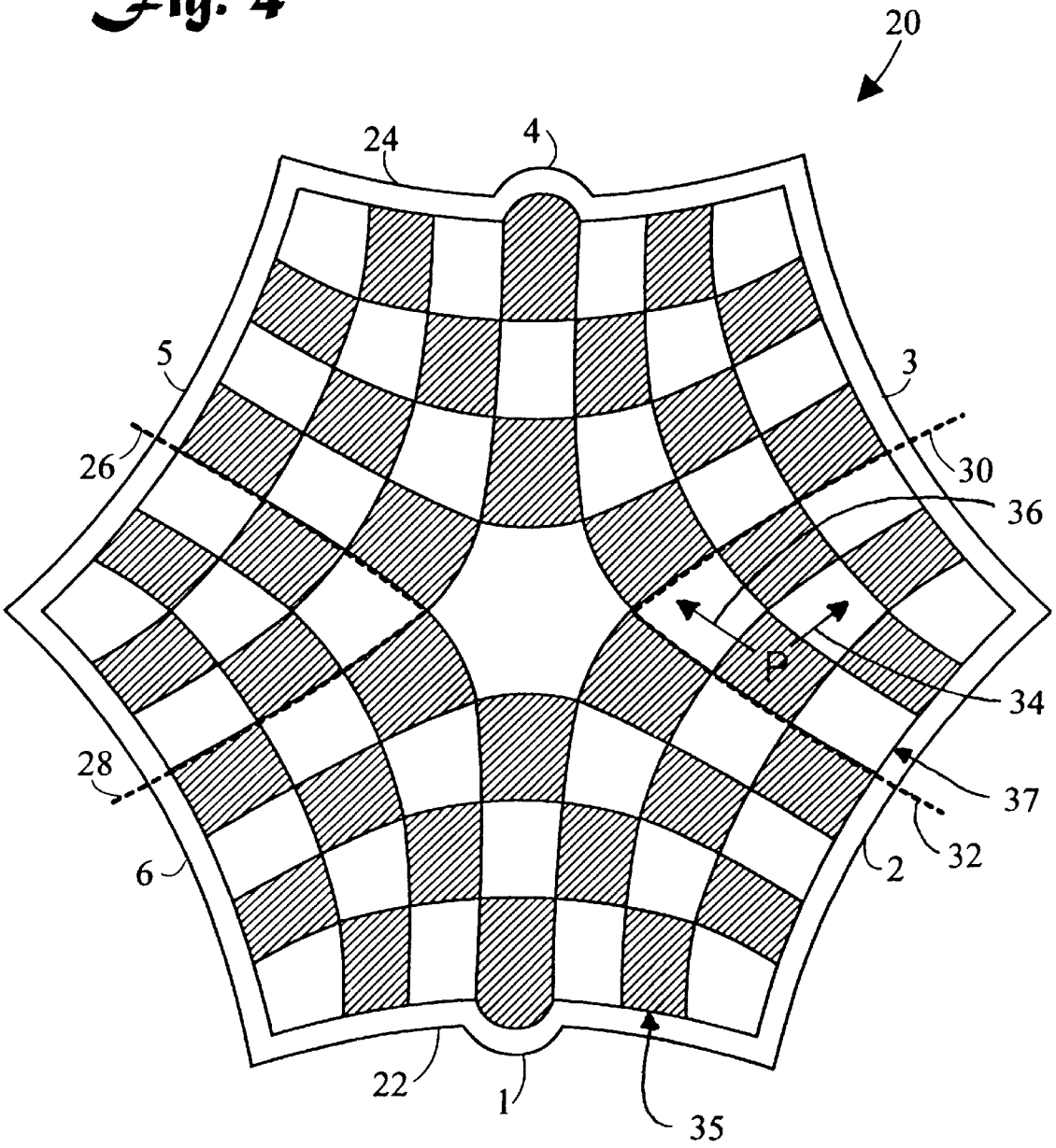
FIG. 4 is a top plan view of the game board of FIG. 1 showing border areas in which a pawn may move in one of two directions.

FIG. 4 is a top plan view of the game board of FIG. 1 showing border areas in which a pawn may move in either of two directions. Lines 26 and 28 define a first border area of nine "squares" (stations), and lines 30 and 32 define a second border area of nine squares. In a preferred playing embodiment, if a pawn in inside either border area, the pawn may move in one of two directions 34 and 36. The reason is that the direction 34 is determined by the column 35 coming from side 1. The direction 36 is determined by the column 37 coming from side 2. It is also noted, that while the pawn can move in one of two directions when in a border area, there are also instances where the pawn can capture an opponent's piece in three directions.

Figure 5:
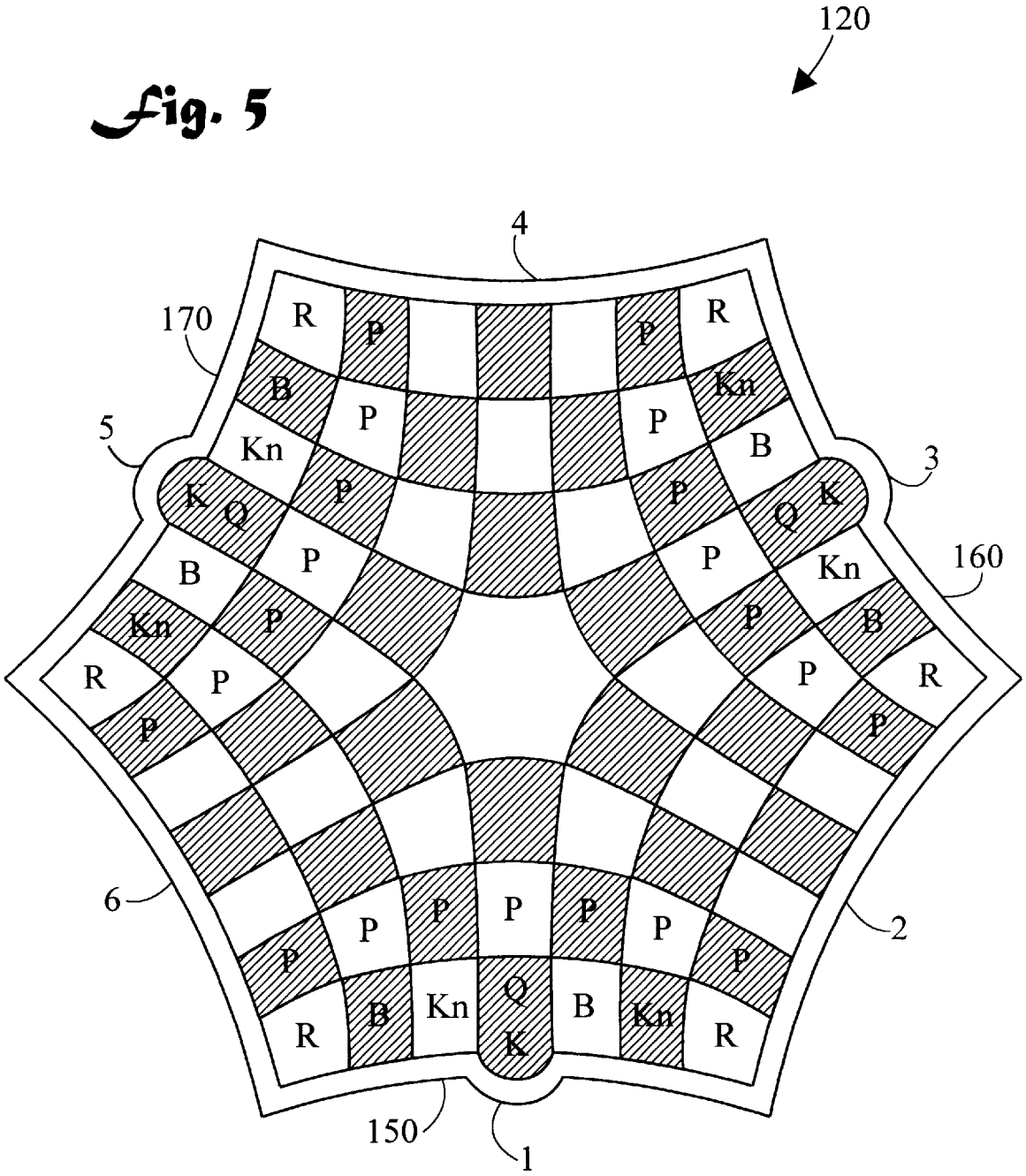
FIG. 5 is a top plan view of a second embodiment of game board, wherein three opposing sets of chess pieces are in an initial game position.

FIG. 5 is a top plan view of a second embodiment of a game board, generally designated as 120. In this embodiment, three opposing sets of chess pieces are in an initial game position. Game board 120 is identical to game board 20, with the exception that there are three equally spaced playing positions rather that two. The playing positions 150, 160, and 170 are indicated by the bulges in the middle edge stations.

Figure 6:
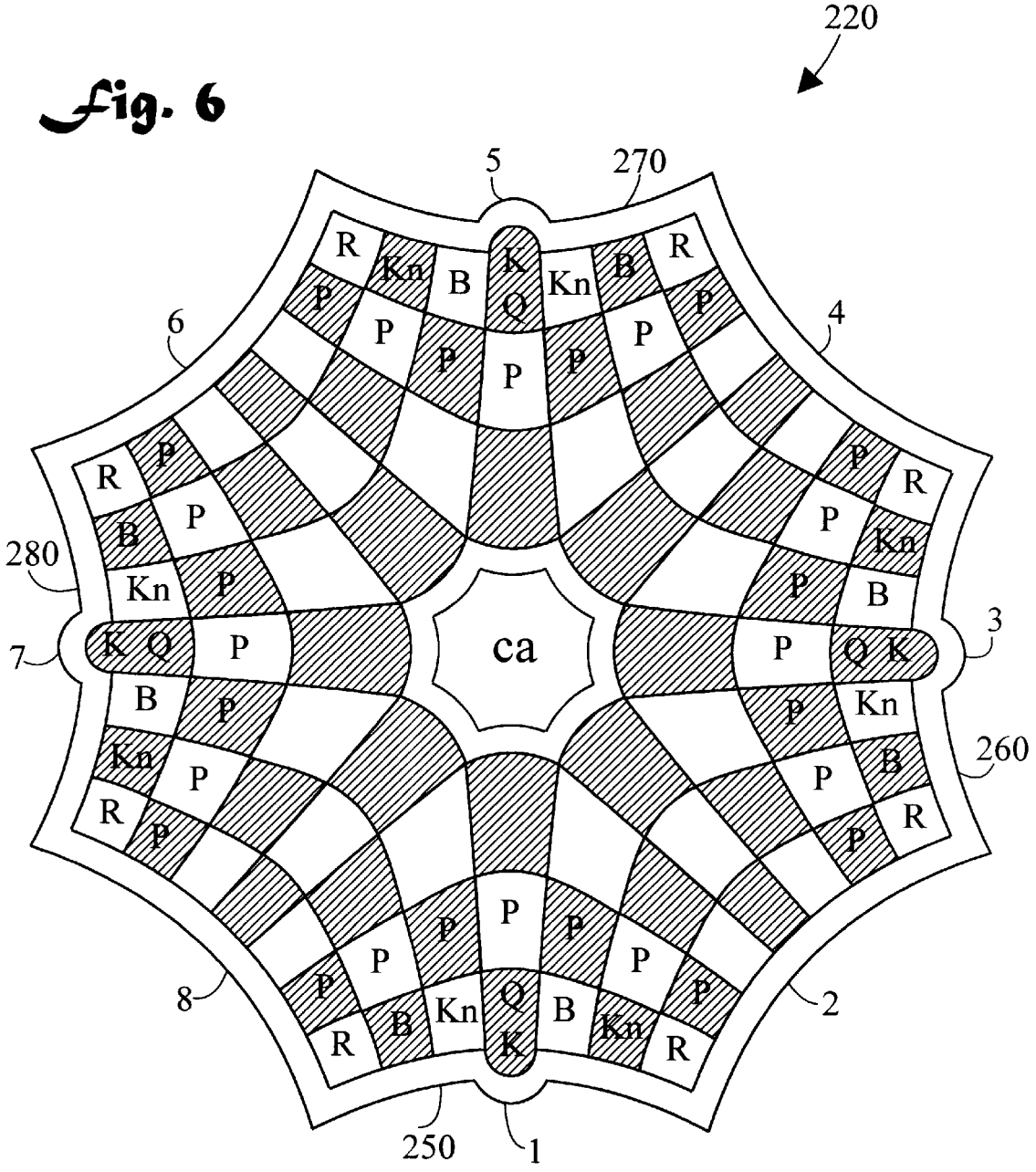
FIG. 6 is a top plan view of an eight-sided game board showing four sets of chess pieces in an initial game position.

FIG. 6 is a top plan view of an eight-sided game board, generally designated as 220, showing four sets of chess pieces in an initial game position. Game board 220 has eight side (1 through 8) and is substantially octagonal in shape. Game board 220 has 48 edge stations that do not overlap other edge stations, 32 first interior edge stations that do not overlap other first interior stations or any edge stations, and 16 second interior stations that do not overlap other second interior stations, any first interior stations, or any edge stations, and a substantially octagonal central area ca. In a preferred embodiment, four players participate, wherein opposite players are teammates. The players occupy playing positions 250, 260, 270, and 280. Game board 220 has the same symmetrical curvilinear arrangement of stations as game board 20.

Figure 7:
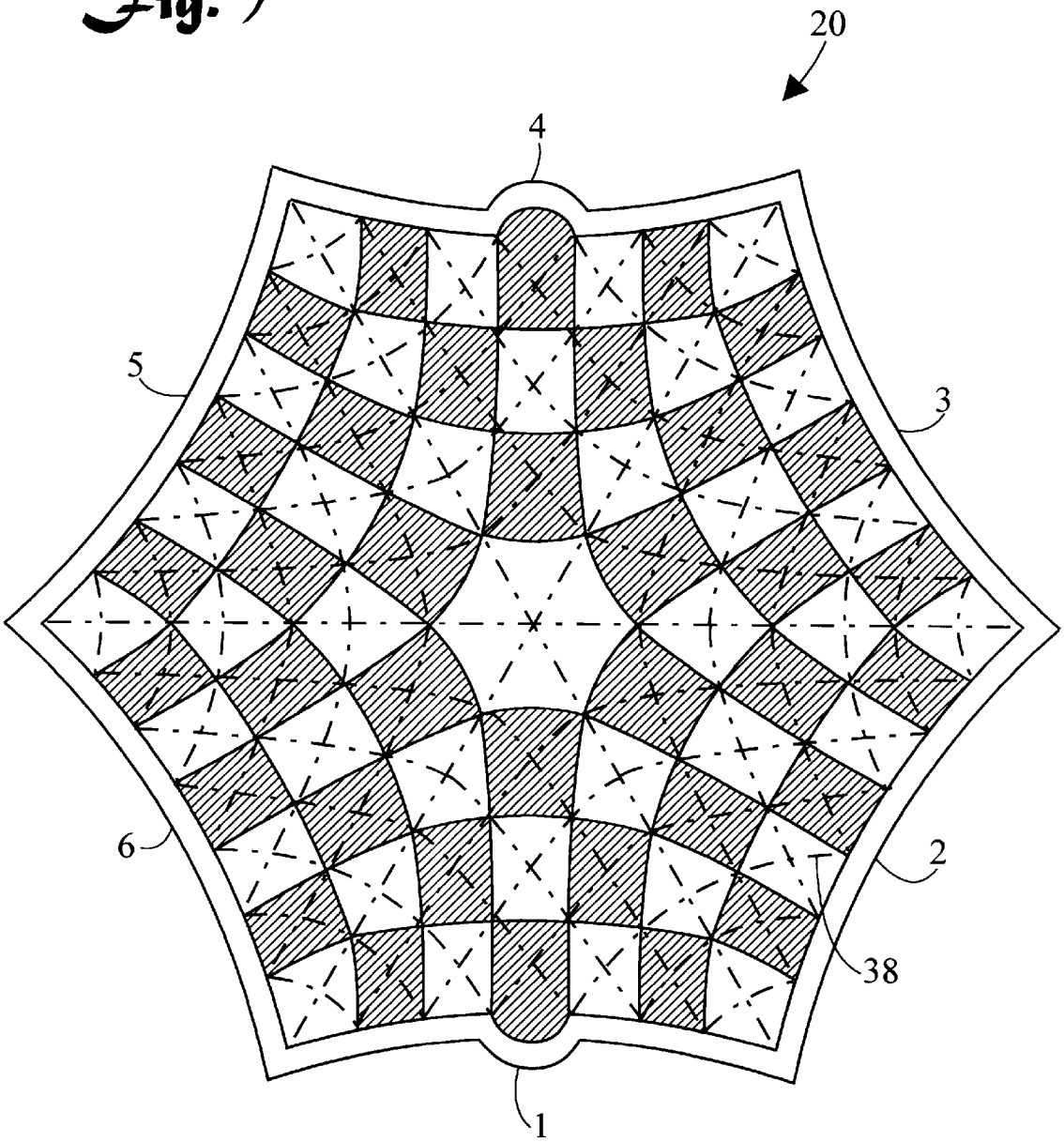
FIG. 7 is a top plan view of the game board of FIG. 1 showing a plurality of curvilinear guidelines; and, FIG. 8 is a top plan view of the game board of FIG. 6 showing a plurality of curvilinear guide lines.

FIG. 7 is a top plan view of game board 20 further including a plurality of curvilinear guide lines 38 which indicate paths of diagonal movement of the chess or checker pieces. The selection of an odd number of edge stations positions the middle edge station in the middle of the side. A straight line movement is then created by a piece moving from the middle of one side to the middle of the opposite side across the central area as shown by the guide lines 38.

It is noted that by selecting the appropriate number of sides m, game board 20 can accommodate any number of players. FIGS, 1, 5, and 6 depict embodiments generally suited for two, three, and four players respectively.

Figure 8:
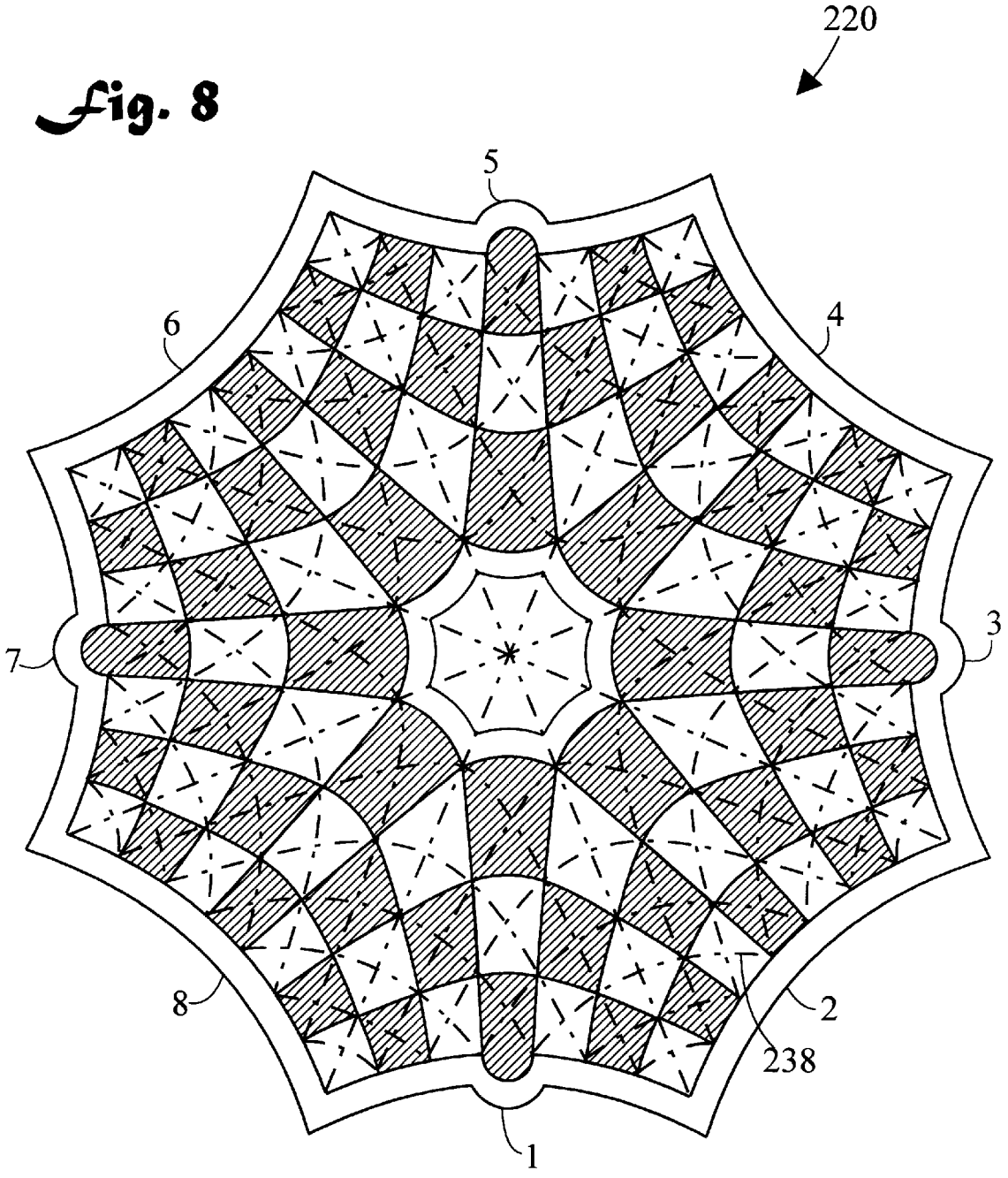

FIG. 8 is a top plan view of the game board 220 of FIG. 6 further including a plurality of curvilinear guidelines 238 which indicate paths of diagonal movement of the chess or checker pieces. The selection of an odd number of edge stations positions the middle edge station in the middle of the side. A straight line movement is created by a piece moving from the middle of one side to the middle of the opposite side across the central area.

Using game board 20, chess pieces are moved in general accordance with conventional rules of play. The edge stations, first interior stations, second interior stations, and the central area ca are treated just like the squares of a standard 8×8 chess board. It is noted that the central area ca may be reached by any piece except the off-color bishop. Another interesting feature is that if a piece resides upon the central area ca, it has more move options than are available in conventional chess. For example, referring to FIG. 1, if a castle is in the central area ca, it may move in any of six directions rather than the usual four. Similarly, a queen can move in 12 directions rather than eight, a bishop in six directions rather than four, etc. The number of move options of course increases as the number of sides increases.

In playing a game of chess using game board 20, certain rule changes are preferred. First, since there are only seven edge stations, in the initial game position the king and the queen both occupy the middle edge station e4. However, once either the king or queen leave edge station e4, they are not again permitted to simultaneously occupy that square. Second, since there are only seven positions in the rank of first interior stations, games are played with only seven pawns. And, the pawn in front of the king and queen (that is the pawn residing on first interior station f4) can initially move only one square. This is to prevent the first player from gaining an unfair advantage by immediately occupying the central area ca.

For a two player game such as is illustrated in FIG. 4, when a pawn is in one of the two designated border areas, it may selectively move in one of two directions.

For a three player game such as is illustrated in FIG. 5, the chess pieces must be of three different colors, and the players play in rotating order, clockwise being preferred. Additionally, a stalemate can only occur after one of the players has been eliminated from play.

For a four player game such as is illustrated in FIG. 6, the game is preferably, but not mandatorily, played by two teams of two players each. The playing partners sit across from on another, and each have the same color pieces. Play rotates around the game board 20, wherein a player may move any of his own pieces or any of his partners pieces. Once the king of one of the players is captured, the partner of that player continues to move for both sides. That is, each team continues to alternate moves.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A game board for playing chess, checkers, and the like, comprising:

said game board having at least four sides;

seven edge stations of two alternating contrasting colors disposed along each said side, said seven edge stations including a middle edge station;

on each said side, seven first interior stations of two alternating contrasting colors inwardly disposed adjacent to said seven edge stations;

on each said side, seven second interior stations of two alternating contrasting colors inwardly disposed adjacent to said seven first interior stations, said seven second interior stations including a middle second interior station;

a central area formed by said middle second interior stations; and, said game board having eight sides and being substantially octagonal in shape.

2. A game board according to claim 1, said game board having 48 edge stations that do not overlap other edge stations, 32 first interior stations that do not overlap other first interior stations or any edge stations, and 16 second interior stations that do not overlap other second interior stations, any first interior stations, or any edge stations.

3. A game board according to claim 1, said central area substantially octagonal in shape.

* * * * *